US011098972B2

(12) United States Patent
Taylor

(10) Patent No.: US 11,098,972 B2
(45) Date of Patent: Aug. 24, 2021

(54) RECOIL SYSTEM FOR A SELF-LOADING FIREARM

(71) Applicant: Taylor Weapons, Inc., Richlands, NC (US)

(72) Inventor: George J. Taylor, Richlands, NC (US)

(73) Assignee: TAYLOR. WEAPONS, INC., Richlands, NC (US)

( * ) Notice: Subject to any disclaimer, the term of this patent is extended or adjusted under 35 U.S.C. 154(b) by 313 days.

(21) Appl. No.: 16/297,697

(22) Filed: Mar. 10, 2019

(65) Prior Publication Data

US 2019/0293379 A1 Sep. 26, 2019

Related U.S. Application Data

(60) Provisional application No. 62/645,552, filed on Mar. 20, 2018.

(51) Int. Cl.
*F41A 25/12* (2006.01)

(52) U.S. Cl.
CPC ..... *F41A 25/12* (2013.01)

(58) Field of Classification Search
CPC ..... F41A 3/82; F41A 3/84; F41A 3/86; F41A 3/88; F41A 25/12
USPC ..... 89/44.01, 198; 42/1.06, 5, 74, 104
See application file for complete search history.

(56) References Cited

U.S. PATENT DOCUMENTS

| | | | | |
|---|---|---|---|---|
| 4,667,566 | A * | 5/1987 | Bosshard | F41A 25/12 89/177 |
| 7,380,487 | B2 * | 6/2008 | Mantras | F41A 3/86 42/1.06 |
| 8,800,424 | B2 * | 8/2014 | Gangl | F41A 3/84 89/198 |
| 2009/0019754 | A1 * | 1/2009 | Moretti | F41A 25/12 42/69.02 |
| 2014/0260946 | A1 * | 9/2014 | Gomez | F41A 3/84 89/191.01 |
| 2018/0010870 | A1 * | 1/2018 | Mantas | F41A 3/86 |
| 2018/0274870 | A1 * | 9/2018 | Law | F41A 3/82 |

OTHER PUBLICATIONS

Kahr Firearms Group, "CM45 Recoil Spring Assembly," https://shopkahrfirearmsgroup.com/pistol-parts/kahr-005cm45-recoil-spring-assembly-005cm45.asp, (c) 2019, Accessed Feb. 13, 2019.

(Continued)

*Primary Examiner* — Bret Hayes
(74) *Attorney, Agent, or Firm* — Bennet K. Langlotz; Langlotz Patent & Trademark Works, LLC

(57) ABSTRACT

A recoil system for a self-loading firearm has a rear mount, a capture element connected to the rear mount with a floor surface and guide rod, a first spring encompassing the guide rod with a rear end abutting the floor surface, a first sleeve defining a bore encompassing the first spring with a forward end abutting a forward end of the first spring, a second spring receiving the first sleeve with a rear end abutting a rear portion of the first sleeve, a second sleeve defining a bore encompassing the second spring with a forward end abutting a forward end of the second spring, a third spring receiving the second sleeve with a rear end abutting a rear portion of the second sleeve, and a bolt carrier having a rear face abutting a forward end of the third spring and an opening receiving a forward end of the second sleeve.

17 Claims, 5 Drawing Sheets

(56) References Cited

OTHER PUBLICATIONS

Kahr Firearms Group, "MK40, MK9 Recoil Spring Assembly," https://shopkahrfirearmsgroup.com/pistol-parts/kahr-005m4e-recoil-spring-assembly-005m9s.asp, (c) 2019, Accessed Feb. 13, 2019.
Denis Prisbey, "Cylinder & Slide's Custom Upgrades For The Kahr PM9," Personal Defense World, https://www.personaldefenseworld.com/2015/10/cylinder-slides-custom-upgrades-for-the-kahr-pm9/, Accessed Feb. 13, 2019.

* cited by examiner

FIG. 5
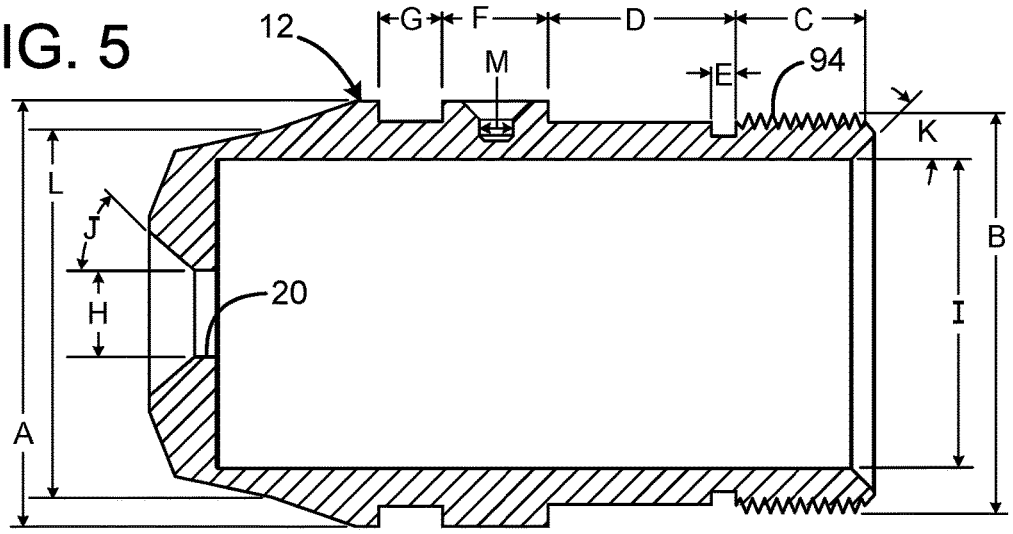
FIG. 6
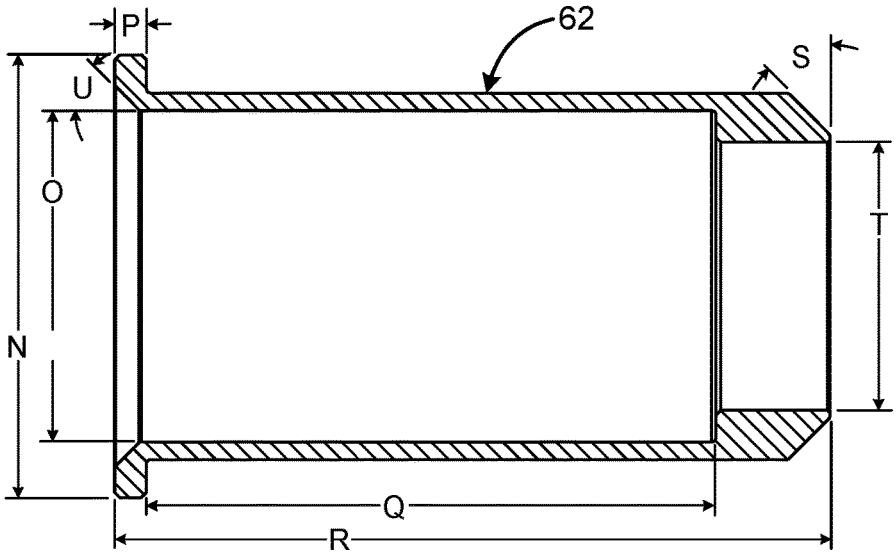
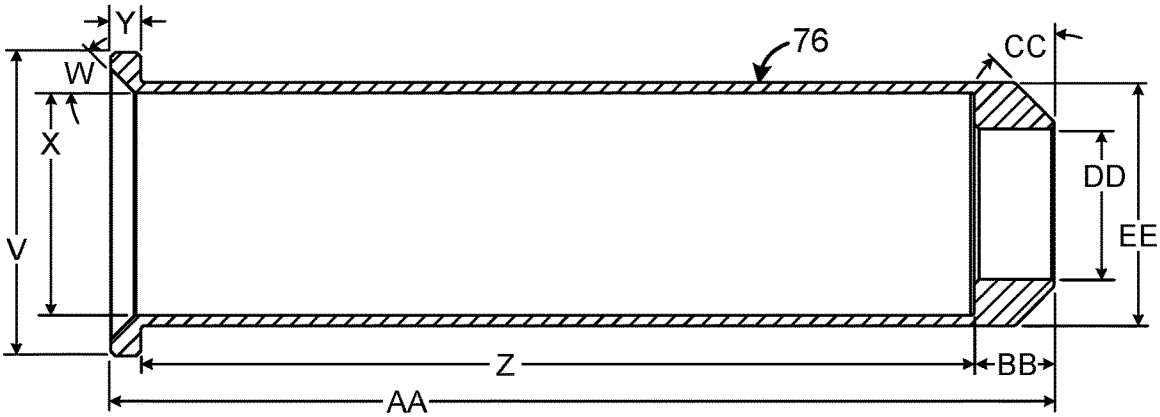
FIG. 7

RECOIL SYSTEM FOR A SELF-LOADING FIREARM

CROSS-REFERENCE TO RELATED APPLICATION

This application claims the benefit of U.S. Provisional Patent Application No. 62/645,552 filed on Mar. 20, 2018, entitled "Short Recoil and Buffer M4 System," which is hereby incorporated by reference in its entirety for all that is taught and disclosed therein.

FIELD OF THE INVENTION

The present invention relates to firearms, and more particularly to recoil systems for self-loading rifles.

BACKGROUND OF THE INVENTION

Many self-loading rifles use direct gas impingement as their mechanism of operation. Gas is trapped from the barrel as the bullet moves past a gas port. The gas enters the port and travels down a gas tube into the rifle's upper receiver. Here, the gas tube protrudes into a bolt carrier key, which receives the gas and transfers it into the bolt carrier.

The bolt and bolt carrier together act as a piston, which moves rearward toward the butt of the firearm as the bolt carrier fills with high pressure gas. A buffer that is aligned with a bolt return spring is located behind the bolt carrier. The bolt return spring pushes the bolt carrier back toward the chamber to return the bolt into battery. The length of the rifle buffer tube (typically 10 inches to receive a 6 inch buffer and a 12.75 inch rifle bolt return spring) can compose a significant portion of the overall length of a self-loading AR-15 rifle (typically 35 inches with a 20 inch barrel and a stock).

Compact rifles are desirable for interior defense and other close quarters battle applications where a longer rifle could be difficult to maneuver or easily snagged. Traditional efforts to produce compact rifles result in either short-barreled rifles (rifles with barrels shorter than 16 inches or that fold to under 26 inches), or rifles that omit a shoulder stock to reduce the firearm's length. Short-barreled rifles are subject to strict regulation under the National Firearms Act. Pistols based on rifles such as the AR-15 avoid these regulations, but are large and heavy, and can be difficult to shoot accurately without a shoulder stock or arm brace to provide stability.

Therefore, a need exists for a new and improved recoil system for a self-loading firearm that decreases the overall length of a firearm by replacing the conventional rifle-length buffer. In this regard, the various embodiments of the present invention substantially fulfill at least some of these needs. In this respect, the recoil system for a self-loading firearm according to the present invention substantially departs from the conventional concepts and designs of the prior art, and in doing so provides an apparatus primarily developed for the purpose of decreasing the overall length of a firearm.

SUMMARY OF THE INVENTION

The present invention provides an improved recoil system for a self-loading firearm, and overcomes the above-mentioned disadvantages and drawbacks of the prior art. As such, the general purpose of the present invention, which will be described subsequently in greater detail, is to provide an improved recoil system for a self-loading firearm that has all the advantages of the prior art mentioned above.

To attain this, the preferred embodiment of the present invention essentially comprises a body defining a bolt passage on a bolt axis, and configured for attachment of a barrel to a forward portion of the body in line with the bolt axis, and having a rear mount facility registered with the bolt axis, a capture element connected to the rear mount facility and having a floor surface facing a forward direction along the bolt axis, a guide rod connected to the capture element and extending along the bolt axis, a first spring closely encompassing the guide rod and having a first spring rear end abutting the floor surface of the capture element, a first sleeve defining a first sleeve bore closely encompassing the first spring and having a first sleeve forward end portion abutting a forward end of the first spring, a second spring closely receiving the first sleeve and having a second spring rear end abutting a rear portion of the first sleeve, a second sleeve defining a second sleeve bore closely encompassing the second spring and having a second sleeve forward end portion abutting a forward end of the second spring, a third spring closely receiving the second sleeve and having a third spring rear end abutting a rear portion of the second sleeve, and a bolt carrier having a rear end with a rear face abutting a forward end of the third spring and defining an opening receiving a forward end of the second sleeve. There are, of course, additional features of the invention that will be described hereinafter and which will form the subject matter of the claims attached.

There has thus been outlined, rather broadly, the more important features of the invention in order that the detailed description thereof that follows may be better understood and in order that the present contribution to the art may be better appreciated.

BRIEF DESCRIPTION OF THE DRAWINGS

FIG. 5 is a side sectional view of the buffer tube of the recoil system for a self-loading firearm of FIG. 1.

FIG. 6 is a side sectional view of the first sleeve of the recoil system for a self-loading firearm of FIG. 1.

FIG. 7 is a side sectional view of the second sleeve of the recoil system for a self-loading firearm of FIG. 1.

The same reference numerals refer to the same parts throughout the various figures.

DESCRIPTION OF THE CURRENT EMBODIMENT

Figure 1:
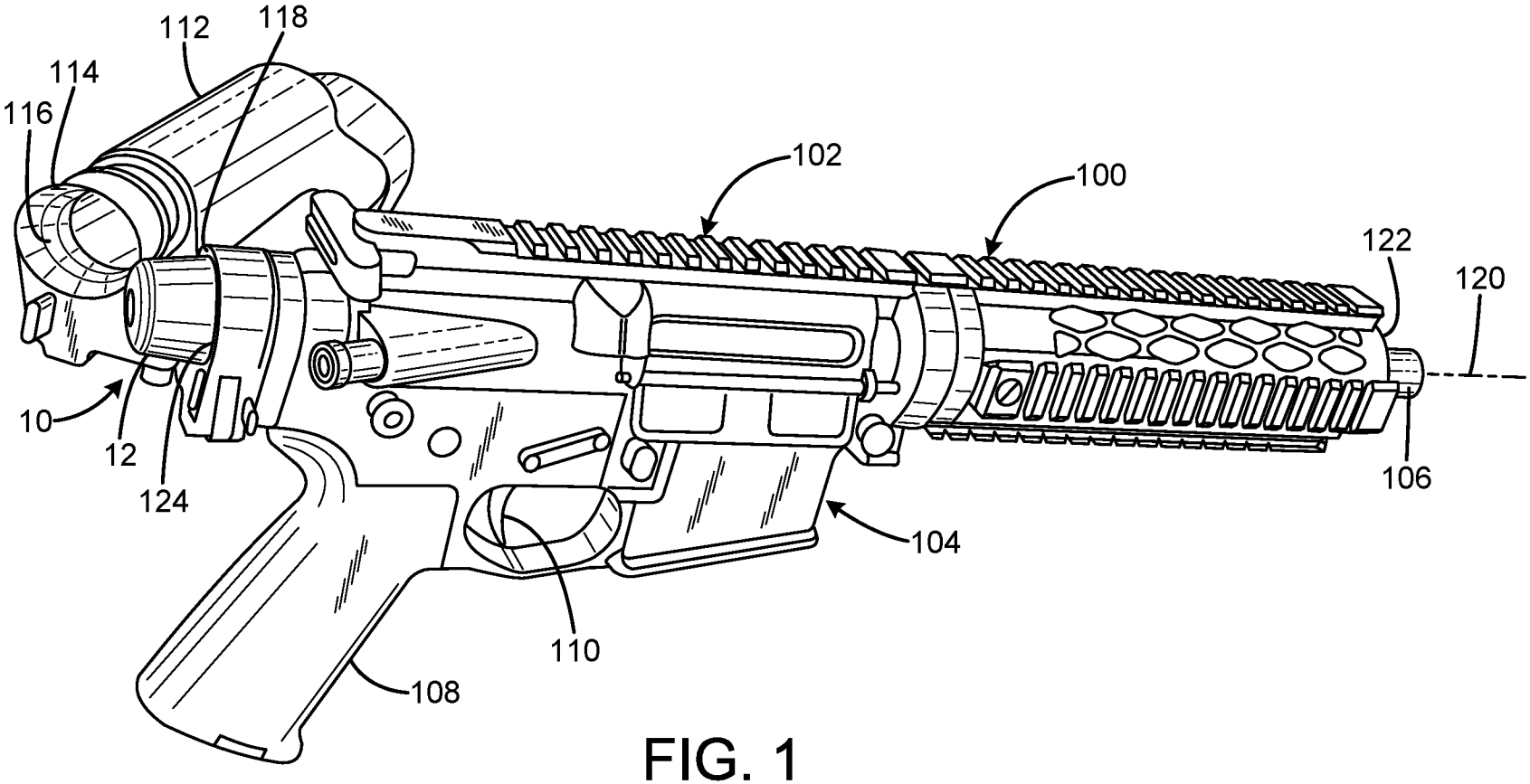
FIG. 1 is a rear perspective view of the current embodiment of the recoil system for a self-loading firearm installed in a firearm.

An embodiment of the recoil system for a self-loading firearm of the present invention is shown and generally designated by the reference numeral 10.

FIG. 1 illustrates the improved recoil system for a self-loading firearm 10 of the present invention. More particularly, the recoil system is shown installed in a firearm 100, which is a self-loading AR-15 pistol in the current embodiment. The firearm has an upper receiver 102, lower receiver 104, barrel 106, pistol grip 108, trigger 110, and folding arm brace 112. The folding arm brace is depicted in the folded condition. The front 114 of the folding arm brace has a cavity 116 that receives the portion of the buffer tube/capture element 12 of the recoil system that protrudes from the rear 118 of the upper receiver. A folding shoulder stock is also compatible with the recoil system and firearm, but would make the firearm a short-barreled firearm subject to the National Firearm Act because it would have a folded length of less than 26 inch. The use of the folding arm brace makes the firearm an AR-15 pistol, which provides some of the advantages of a short-barreled rifle without being subject to the National Firearms Act. Although an auto-loading AR-15 pistol is disclosed and illustrated, the firearm can also be an AR-15 rifle if a stock is used, or an M4 or M16 pistol or rifle if an arm brace or stock are used. It should be appreciated that the recoil system of the current invention results in the shortest-ever M4, M16, or AR-15 platform that uses military-specification upper and lower receivers because the buffer tube 12 only protrudes 1.750 inch from the rear of the upper receiver. In contrast, a conventional rifle length buffer tube protrudes 9.5 inch beyond the lower receiver, and a carbine length buffer tube protrudes from 6.750 inch to 7.750 inch beyond the lower receiver depending upon the manufacturer. The decreased length compared to a conventional AR-15 pistol makes the firearm of the current invention easier to shoot accurately. Furthermore, the firearm with the recoil system of the current invention installed is capable of normal operation even with the folding arm brace or stock in the folded condition, or completely removed. The folding arm brace or stock factory release button has been replaced with a two-piece spring-tensioned button that allows for both the folding of a stock or brace and rapid removal by depressing the button to a second stage that releases the stock or brace completely from the groove "G" in FIG. 5. Groove "G" in FIG. 5 also allows for the folding stock or brace to be quickly attached by pushing it forward until the spring tension locks it into groove "G".

The upper receiver 102 in combination with a bolt carrier 32 is a body that defines a bolt passage 126 on a bolt axis 120. The upper receiver is configured for attachment of the barrel 106 to a forward portion 122 of the upper receiver in line with the bolt axis. The upper receiver has a threaded rear mount facility 124 registered with the bolt axis.

Figure 2:
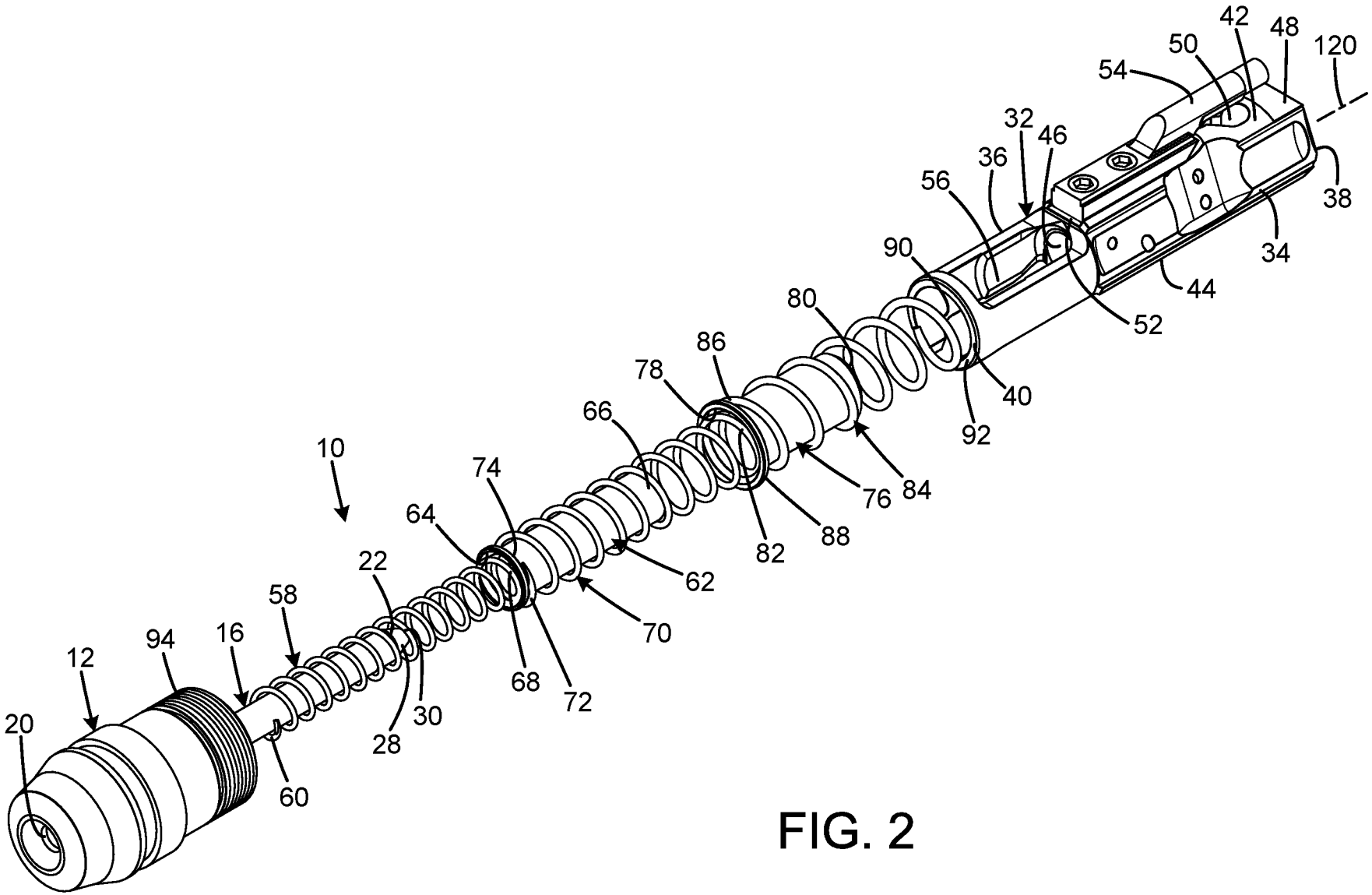
FIG. 2 is a rear isometric exploded view of the current embodiment of the recoil system for a self-loading firearm of FIG. 1.
Figure 3:
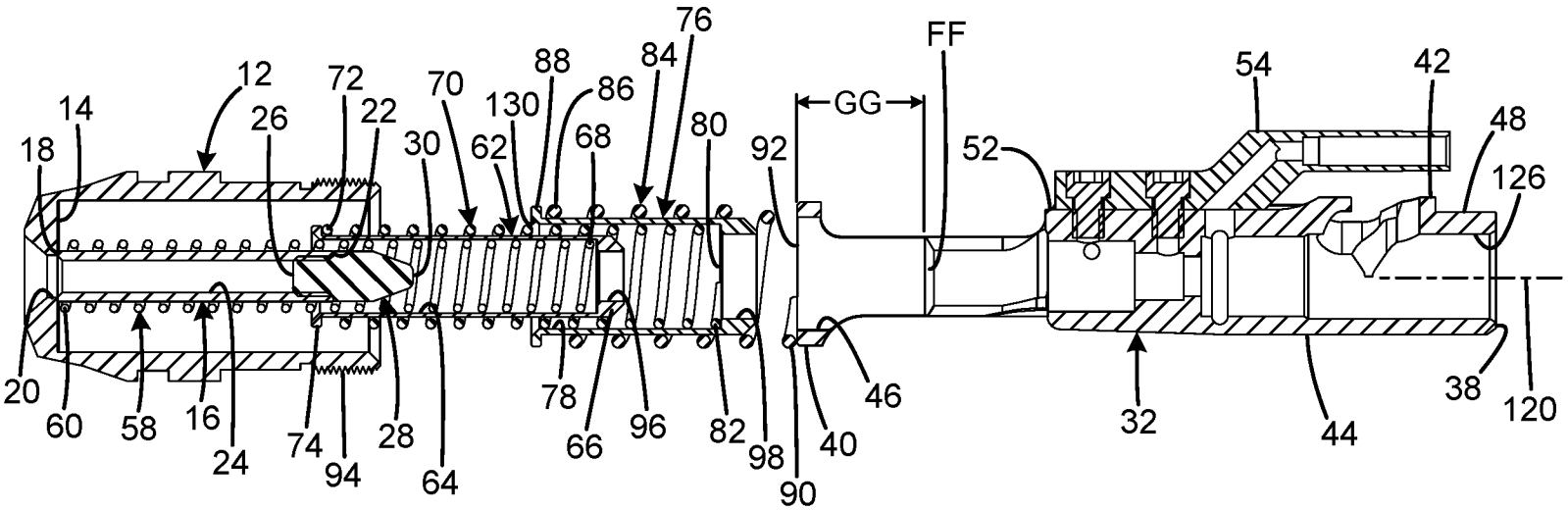
FIG. 3 is a side sectional view of the recoil system for a self-loading firearm of FIG. 1 in the battery condition.

FIGS. 2 & 3 illustrate the improved recoil system for a self-loading firearm 10 of the present invention. More particularly, FIG. 3 shows the recoil system in the battery position. The recoil system has a buffer tube/capture element 12 that is an external cap that threadedly connects to the rear mount facility 128 on the upper receiver 102 using external threads 94. The buffer tube has a floor surface 14 facing a forward direction along the bolt axis 120. A guide rod 16 has a rear 18 forming a hex head (not visible) secured to the floor surface by threads (not shown) threadedly engaged with threaded aperture 20 in the floor surface. The front 22 of the guide rod extends along the bolt axis and defines a central bore 24 that receives the rear 26 of a bolt carrier stop 28. The bolt carrier stop provides a tapered rubber tip 30 to the guide rod in the current embodiment. The guide rod and tapered rubber tip stop further rearward movement of the bolt carrier 32 when the recoil system reaches the full recoil compressed condition illustrated in FIG. 4 to prevent coil bind of the first, second, and third springs 58, 70, 84. Coil bind is highly undesirable because a spring experiencing coil bind has been found to be permanently deformed in as little as twenty discharge cycles.

The bolt carrier 32 has a right side 34, left side 36, front face 38, rear end portion 40, top 42, and bottom 44. The front face and rear end portion define a central bore 46 axially registered with the bolt axis 120. The top front of the frame defines a charging handle engagement shelf 48. A cam slot 50 is defined by the top of the frame immediately behind the charging handle engagement shelf. A gas key attachment area 52 is machined in the top of the frame directly behind the cam slot. A gas key 54 is attached to the gas key attachment area. A hammer clearance slot 56, which communicates with the central bore 46 is machined in the top of the frame immediately behind the carrier key attachment area.

The first spring 58 closely encompasses the guide rod 16 and has a first spring rear end 60 abutting the floor surface 14 of the buffer tube/capture element 12. A first sleeve 62 defining a first sleeve bore 64 closely encompasses the first spring and has a first sleeve forward end portion 66 abutting a forward end 68 of the first spring. The second spring 70 closely receives the first sleeve and has a second spring rear end 72 abutting a rear external flange portion 74 of the first sleeve. A second sleeve 76 defining a second sleeve bore 78 closely encompasses the second spring and has a second sleeve forward end portion 80 abutting a forward end 82 of the second spring. The third spring 84 closely receives the second sleeve and has a third spring rear end 86 abutting a rear external flange portion 88 of the second sleeve. The second sleeve includes a rear internal diagonal chamfer 130. The rear end portion 40 of the bolt carrier 32 has a rear face 92 abutting a forward end 90 of the third spring. The central bore 46 in the bolt carrier is an opening receiving the second sleeve forward end portion.

In the current embodiment, the first, second, and third springs 58, 70, 84 are compression coil springs made of steel. The buffer tube 12, first sleeve 62, and second sleeve 76 are preferably made of tool steel to provide sufficient durability to withstand repeated exposure to recoil forces. It is believed plastic components would not last, and aluminum components would be too soft. The first sleeve forward end portion 66 defines a limited first aperture 96 configured to closely receive the guide rod and having a diameter smaller than an outside diameter of the first spring. The rear external flange portion 74 of the first sleeve is a first external flange having a greater diameter than the interior diameter of the second spring. The second sleeve forward end portion 80 defines a limited forward second aperture 98 configured to closely receive the first sleeve, and a diameter smaller than an outside diameter of the second spring. The rear external flange portion 88 of the second sleeve is a second external flange having a greater diameter than the interior diameter of the third spring. The first sleeve is axially movable with respect to the buffer tube/capture element 12 and with respect to the bolt carrier 32. The first sleeve is suspended between the buffer/tube capture element and the bolt carrier with axial support only by the first and second springs.

Figure 4:
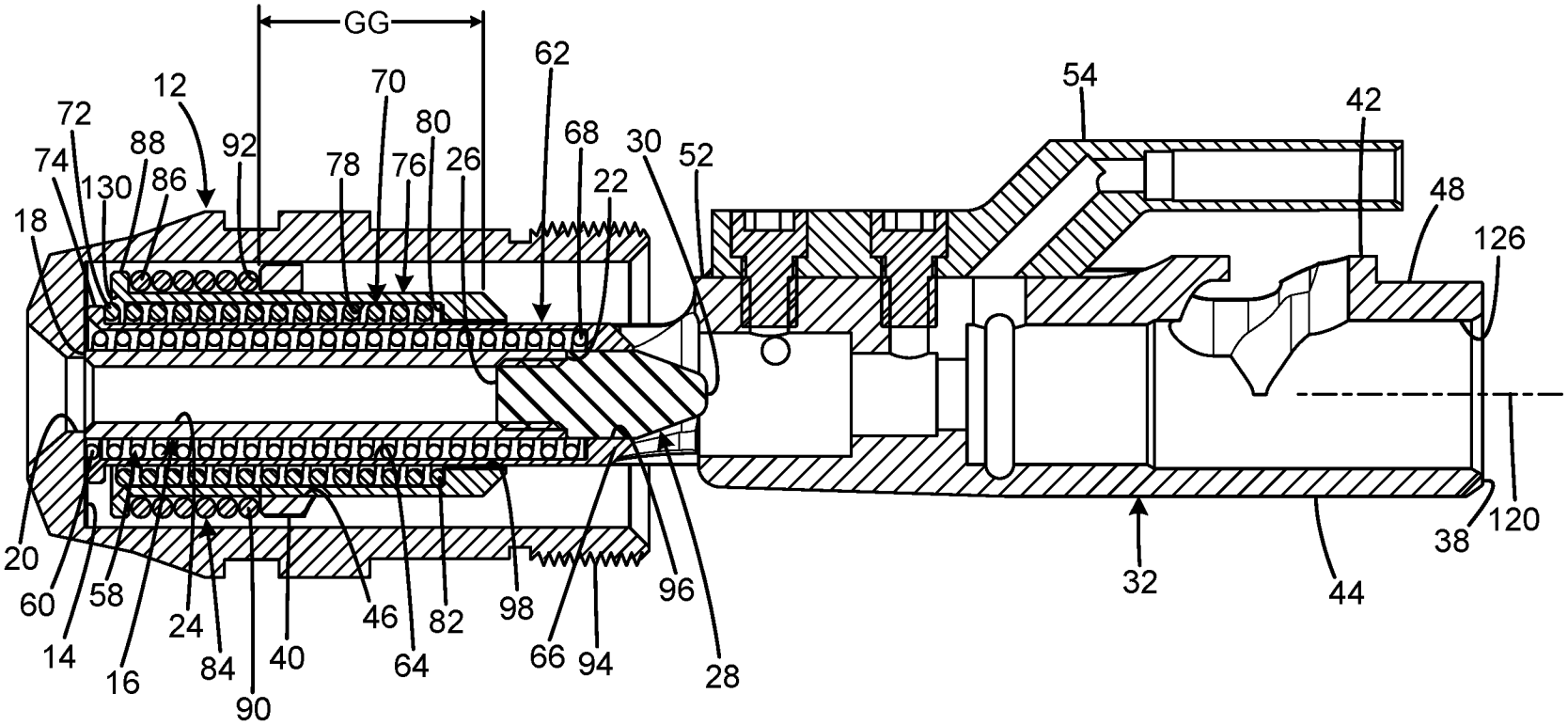
FIG. 4 is a side sectional view of the recoil system for a self-loading firearm of FIG. 1 in the full recoil condition.

FIG. 4 illustrates the improved recoil system for a self-loading firearm 10 of the present invention. More particularly, FIG. 4 shows the recoil system in the recoil position. By comparing FIGS. 3 & 4, it is readily apparent that the bolt carrier 32 is movable between a recoil position (FIG. 4) and a battery position (FIG. 3). The first sleeve forward end portion 66 is forward of the second sleeve forward end portion 80 when the bolt carrier is in the recoil position. The majority of the first sleeve 62 is forward of the forward end/front 22 of the guide rod 16 when the bolt carrier is in the battery position. The majority of the second sleeve 76 is forward of the first sleeve forward end portion when the bolt carrier is in the battery position. The rear end portion 40 of the bolt carrier is forward of a majority of the second sleeve when the bolt carrier is in the battery position. The forward end 82 of the second spring 70 is rearward of the forward end 68 of the first spring 58 when the bolt carrier is in the recoil position. The second spring rear end 72 is forward of the first spring rear end 60 when the bolt carrier is in the recoil position. The forward end of the third spring 84 is rearward of the forward end 82 of the second spring when the bolt carrier is in the recoil position. The third spring rear end 86 is forward of the second spring rear end when the bolt carrier is in the recoil position.

It should also be appreciated that the first sleeve 62 receives the first spring 58, the second spring 70 receives the first sleeve, the second sleeve 76 receives the second spring, and the third spring 84 receives the second sleeve. The first sleeve forward end portion 66 operably engages the forward end 68 of the first spring, and the rear external flange portion 74 of the first sleeve operably engages a second spring rear end 72. The second sleeve forward end portion 80 operably engages the forward end 82 of the second spring, and the rear external flange portion 88 of the second sleeve operably engages the third spring rear end 86. The forward end portions of the first and second sleeves serve as internal forward stops.

FIG. 5 illustrates the buffer tube/capture element 12. In the current embodiment, the buffer tube/capture element has an outer diameter A of 1.307+/−0.005 inch, an outer diameter B of 1.1875+/−0.005 inch, an external threaded area C that is 0.420 inch wide with external threads 94 that are 1 3/16×16 threads per inch, an external area D that is 0.580 inch wide, an external groove E that is 0.0875 inch wide and 0.090 inch deep, an external area F that is 0.300 inch wide, an external groove G that is 0.195 inch wide and 0.090 inch deep, the threaded aperture 20 with a width denoted by H of 0.255 inch, an inner diameter I of 0.937 inch, 45° angles J and K, an outer diameter L of 1.150 inch, and a fixture hole M with a diameter of 0.195 inch and a depth of 0.085 inch. The buffer tube/capture element has a maximum interior depth of 2.050 inch.

FIG. 6 illustrates the first sleeve 62. In the current embodiment, the first sleeve has an outer diameter N of 0.630 inch, an inner diameter O of 0.453 inch, an external area P that is 0.092 inch wide, an external area Q that is 1.730 inch wide, an external area R that is 1.820 inch wide, 45° angles S, an inner diameter T of 0.332 inch, and 45° angles U.

FIG. 7 illustrates the second sleeve 76. In the current embodiment, the second sleeve has an outer diameter V of 0.880 inch, 45° angles W, an inner diameter X of 0.656 inch, an external area Y that is 0.060 inch wide, an external area Z that is 1.310 inch wide, an external area AA that is 1.375 inch wide, an external area BB that is 0.150 inch wide, 45° angles CC, an inner diameter DD of 0.531 inch, and an outer diameter EE of 0.730 inch.

In the current embodiment, the bolt carrier 32 has 45° angle stops FF, and the second sleeve 76 has a 45° mating angle CC that stops the second sleeve to prevent coil bind of the third spring 84. The bolt carrier has ledge depth GG of 0.760 inch. The bolt carrier has an overall length of 4.400 inch for .223/5.56, 7.62×39, and 300 AAC Blackout cartridges. The guide rod 16 has an outer diameter of 0.320 inch and a length of 1.740 inch. The exposed portion of the bolt carrier stop 28 provides an additional length of 0.360 inch. In the full recoil condition shown in FIG. 4, the nested springs and sleeves compress to a point that they only add an additional length of 0.550 inch to the total length of the bolt carrier. This makes the overall length of the bolt carrier and recoil system when compressed during recoil and extraction less than 5.000 inch. However, the bolt carrier is still capable of the full amount of longitudinal movement associated with an AR-15 or M-16 having a conventional length buffer tube. The resiliency characteristics of the second spring 70 can be modified to accommodate the recoil characteristics associated with the caliber of the cartridge being used. For example, a lighter second spring can be used with a suppressed 300 Blackout cartridge with a light round, and a heavier second spring can be used with a 7.62×39 cartridge.

In the context of the specification, the terms "rear" and "rearward," and "front" and "forward" have the following definitions: "rear" or "rearward" means in the direction away from the muzzle of the firearm while "front" or "forward" means it is in the direction towards the muzzle of the firearm. Furthermore, the term "battery position" means the firearm is loaded and the bolt is locked, making the firearm ready to fire. The term "recoil position" means the firearm has discharged and is the point where the bolt carrier has reached its maximum point of rearward movement.

While a current embodiment of a recoil system for a self-loading firearm has been described in detail, it should be apparent that modifications and variations thereto are possible, all of which fall within the true spirit and scope of the invention. With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention. For example, although a gas impingement mechanism of operation has been disclosed, piston or blowback-operated mechanisms of operation could also be used.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A firearm comprising:

a body defining a bolt passage on a bolt axis, and configured for attachment of a barrel to a forward portion of the body in line with the bolt axis, and having a rear mount facility registered with the bolt axis;

a capture element connected to the rear mount facility and having a floor surface facing a forward direction along the bolt axis;

a guide rod connected to the capture element and extending along the bolt axis;

a first spring encompassing the guide rod and having a first spring rear end abutting the floor surface of the capture element;

a first sleeve defining a first sleeve bore encompassing the first spring and having a first sleeve forward end portion abutting a forward end of the first spring;

a second spring receiving the first sleeve and having a second spring rear end abutting a rear portion of the first sleeve;

a second sleeve defining a second sleeve bore encompassing the second spring and having a second sleeve forward end portion abutting a forward end of the second spring;

a third spring receiving the second sleeve and having a third spring rear end abutting a rear portion of the second sleeve; and a bolt carrier having a rear end with a rear face abutting a forward end of the third spring and defining an opening operable to receive the second sleeve forward end portion.

2. The firearm of claim 1 wherein the capture element is an externally threaded cap.

3. The firearm of claim 1 wherein each spring is a compression coil spring.

4. The firearm of claim 1 wherein the first sleeve forward end portion defines a limited first aperture configured to receive the guide rod and having a diameter smaller than an outside diameter of the first spring.

5. The firearm of claim 1 wherein the rear portion of the first sleeve includes a first external flange having a greater diameter than the interior diameter of the second spring.

6. The firearm of claim 1 wherein at the second sleeve forward end portion defines a limited second aperture configured to receive the first sleeve and having a diameter smaller than an outside diameter of the second spring.

7. The firearm of claim 1 wherein the rear portion of the second sleeve includes a second external flange having a greater diameter than an interior diameter of the third spring.

8. The firearm of claim 1 wherein the first sleeve is axially movable with respect to the capture element and with respect to the bolt carrier.

9. The firearm of claim 1 wherein the first sleeve is suspended between the capture element and the bolt carrier with axial support only by the first and second springs.

10. The firearm of claim 1 wherein the bolt carrier is movable between a recoil position and a battery position, and wherein the first sleeve forward end portion is forward of the second sleeve forward end portion when in the recoil position.

11. The firearm of claim 1 wherein the bolt carrier is movable between a recoil position and a battery position, and wherein the majority of the first sleeve is forward of a forward end of the guide rod when the bolt carrier is in the battery position.

12. The firearm of claim 1 wherein the bolt carrier is movable between a recoil position and a battery position, and wherein the majority of the second sleeve is forward of the first sleeve forward end portion when the bolt carrier is in the battery position.

13. The firearm of claim 1 wherein the bolt carrier is movable between a recoil position and a battery position, and wherein the rear end of the bolt carrier is forward of a majority of the second sleeve when the bolt carrier is in the battery position.

14. The firearm of claim 1 wherein the bolt carrier is movable between a recoil position and a battery position, and wherein the forward end of the second spring is rearward of the forward end of the first spring when the bolt carrier is in the recoil position.

15. The firearm of claim 14 wherein the second spring rear end is forward of the first spring rear end when the bolt carrier is in the recoil position.

16. The firearm of claim 15 wherein the third spring rear end is forward of the second spring rear end when the bolt carrier is in the recoil position.

17. The firearm of claim 14 wherein the forward end of the third spring is rearward of the forward end of the second spring when the bolt carrier is in the recoil position.

* * * * *